US010233823B2

(12) United States Patent
Kikuchi et al.

(10) Patent No.: US 10,233,823 B2
(45) Date of Patent: Mar. 19, 2019

(54) THERMOSTAT MONITOR

(71) Applicant: MAZDA MOTOR CORPORATION, Hiroshima (JP)

(72) Inventors: Takayuki Kikuchi, Hiroshima (JP); Susumu Takano, Hiroshima (JP); Shin Miura, Hiroshima (JP); Goro Sakata, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 15/463,583

(22) Filed: Mar. 20, 2017

(65) Prior Publication Data

US 2017/0276057 A1 Sep. 28, 2017

(30) Foreign Application Priority Data

Mar. 25, 2016 (JP) ..... 2016-061587
Mar. 25, 2016 (JP) ..... 2016-061588

(51) Int. Cl.
*F01P 11/16* (2006.01)

(52) U.S. Cl.
CPC ..... *F01P 11/16* (2013.01); *F01P 2031/32* (2013.01)

(58) Field of Classification Search
CPC ..... F01P 11/16; F01P 11/14; F01P 2031/00; F01P 2031/20; F01P 7/16; F01P 2023/00; F01P 2025/50; F01P 2037/00
See application file for complete search history.

(56) References Cited

U.S. PATENT DOCUMENTS 8,046,150 B2 * 10/2011 Anilovich ..... F01P 11/18 123/41.31
8,122,858 B2 * 2/2012 Fujimoto ..... F01P 11/16 123/41.1
8,573,163 B2 * 11/2013 Kinomura ..... F01P 7/165 123/41.02
9,217,689 B2 * 12/2015 Rollinger ..... F01P 7/048
2002/0099482 A1 * 7/2002 Reese, II ..... F01P 11/14 701/31.4
2010/0116228 A1 * 5/2010 Fujimoto ..... F01P 11/16 123/41.1
2012/0106590 A1 5/2012 Suzuki
2012/0137992 A1 * 6/2012 Kinomuka ..... F01P 7/165 123/41.08

FOREIGN PATENT DOCUMENTS

JP 2011-074829 A 4/2011

* cited by examiner

*Primary Examiner* — Long T Tran
(74) *Attorney, Agent, or Firm* — Studebaker & Brackett PC

(57) ABSTRACT

Provided is a thermostat monitor (36) comprising a thermostat open failure detecting part (38) for detecting an open failure of a thermostat when a condition is such that a radiator heat radiation amount (14) radiated from a radiator on a radiator-side cooling water channel is larger than a heater core heat radiation amount (12) radiated from a heater core on a heater core-side cooling water channel, and that a difference between the radiator heat radiation amount and the heater core heat radiation amount is equal to or more than a predetermined value A. Based on a temperature of engine cooling water detected by a temperature sensor positioned in the vicinity of an outlet of an in-engine cooling water channel, it is possible to detect the open failure of the thermostat relatively easily with certainty.

6 Claims, 4 Drawing Sheets

THERMOSTAT MONITOR

TECHNICAL FIELD

The present invention relates to a thermostat monitor, and more particularly to a thermostat monitor for detecting an open failure of a thermostat in an arrangement including an engine, a heater core and a radiator positioned on an engine cooling water channel system of a vehicle, wherein the thermostat positioned on a radiator-side cooling water channel in the engine cooling water channel.

BACKGROUND ART

Conventionally, a vehicle generally has an engine cooling water channel with an engine, a heater core and a radiator located on the engine cooling water channel, and a thermostat monitor for detecting an open failure of a thermostat uses two temperature sensors comprising an outlet-region temperature sensor positioned in the vicinity of an outlet of an in-engine cooling water channel included in the engine cooling water channel, and a radiator-side temperature sensor provided on a radiator-side cooling water channel. Temperatures at two locations (temperature of the engine cooling water flowing out from the in-engine cooling water channel and temperature of the engine cooling water flowing out from the radiator-side temperature sensor) are directly measured respectively by such two temperature sensors, to thereby directly determine a decrease in temperature of the engine cooling water flowing out from the radiator-side cooling water channel.

SUMMARY

Technical Problem

However, the above conventional arrangement is constructed to include two temperature sensors positioned for detecting the open failure of the thermostat, so that there has been an increase in an overall cost due to an increase in component cost of the temperature sensors, an increase in manufacturing cost for assembling operation, and an increase in cost for ensuring reliability of the temperature sensors or the like. Thus, efforts have hitherto been made for establishing a way of detecting the open failure of the thermostat only by the outlet-region temperature sensor, omitting the radiator-side temperature sensor provided on the radiator-side cooling water channel.

For example, Patent Document 1 (JP2011-074829A) describes a diagnostic device for detecting an open failure of the thermostat by using one temperature sensor positioned on an engine cooling water channel under a condition that vehicle speed is beyond a predetermined value.

However, in the diagnostic device described in Patent Document 1, the vehicle speed must be in the condition required for detecting the open failure of the thermostat, so that there is a problem that it is necessary to acquire various data, and also, very complex procedures are required for processing such data. In addition, a very complex processing has to be executed, so that there is a problem that an additional load is incurred on a control device.

The present invention has been made to solve the above conventional problems, and an object thereof is to provide a thermostat monitor which can detect the open failure of the thermostat relatively easily and with certainty based on the temperature of the engine cooling water detected by the temperature sensor positioned in the vicinity of the outlet of the in-engine cooling water channel.

Solution to Technical Problem

In order to achieve the above object, according to the present invention, there is provided a thermostat monitor for detecting an open failure of a thermostat in an engine cooling water channel system, based on a temperature of an engine cooling water detected by a temperature sensor, the engine cooling water channel system having an engine, a heater core and a radiator of a vehicle positioned thereon, the engine cooling water channel system comprising an in-engine cooling water channel, a radiator-side cooling water channel and a heater core-side cooling water channel, the thermostat positioned on the radiator-side cooling water channel, and the temperature sensor positioned in the vicinity of an outlet of the in-engine cooling water channel, wherein the thermostat monitor comprises a thermostat open failure detecting part for detecting an occurrence of the open failure of the thermostat when a radiator heat radiation amount radiated from the radiator on the radiator-side cooling water channel is larger than a heater core heat radiation amount radiated from the heater core on the heater core-side cooling water channel, and when a difference between the radiator heat radiation amount and the heater core heat radiation amount is equal to or more than a predetermined value.

According to the present invention having the above features, the thermostat monitor is configured such that the open failure of the thermostat is detected based on the temperature of the engine cooling water detected by the temperature sensor positioned in the vicinity of the outlet of the in-engine cooling water channel, and functions to distinguish a state wherein a decrease in the engine cooling water temperature is caused by an open failure of the thermostat from a state wherein the temperature of the engine cooling water is decreased by the heat radiation of the heater core, when the amount of heat radiated from the radiator (hereinafter referred as "radiator heat radiation amount") is larger than the amount of heat radiated from the heater core (hereinafter referred as "heater core radiation amount"), and when the difference between the radiator heat radiation amount and the heater core heat radiation amount is equal to or more than the predetermine value, although a decrease in the engine cooling water temperature may possibly be caused either by the open failure of the thermostat or by the heat radiation of the heater core, and thus, it is possible to detect the open failure of the thermostat relatively easily with certainty.

According to the present invention, preferably, the thermostat monitor further comprises a vehicle speed determining part for having the thermostat open failure detecting part start the detection when vehicle speed of the vehicle is equal to or more than a predetermined vehicle speed, wherein the predetermined vehicle speed is set such that a relationship is established such that the radiator heat radiation amount is larger than the heater core heat radiation amount, and the difference between the radiator heat radiation amount and the heater core heat radiation amount is equal to or more than the predetermined value.

According to the present invention having the above features, the thermostat monitor functions to detect the open failure of the thermostat based on the temperature of the engine cooling water detected by the temperature sensor positioned in the vicinity of the outlet of the in-engine cooling water channel, and when the relationship is established such that the radiator heat radiation amount, which is increased as the vehicle speed is increased, is larger than the heater core heat radiation amount which is maintained substantially constant with respect to a change in the vehicle speed, and that the difference between the radiator heat radiation amount and the heater core heat radiation amount is equal to or more than the predetermined value, so that it is possible for the thermostat open failure detecting part to determine that, among the state where the temperature of the engine cooling water is decreased by the heat radiation of the heater core and the state where the temperature of the engine cooling water is decreased by the open failure of the thermostat, the latter (the state where the temperature of the engine cooling water is decreased by the open failure of the thermostat) is occurring, and thus, it is possible to detect the open failure of the thermostat relatively easily with certainty.

In addition, in order to achieve the above object, according to the present invention, there is provided a thermostat monitor for detecting an open failure of a thermostat in an engine cooling water channel system, based on a temperature of an engine cooling water detected by a temperature sensor, the engine cooling water channel system having an engine, a heater core and a radiator of a vehicle positioned thereon, the engine cooling water channel system comprising an in-engine cooling water channel, a radiator-side cooling water channel and a heater core-side cooling water channel, the thermostat positioned on the radiator-side cooling water channel, and the temperature sensor positioned in the vicinity of an outlet of the in-engine cooling water channel, wherein the thermostat monitor comprises a temperature difference determining part for having the detection of the open failure of the thermostat started when a condition is met such that a temperature difference between the temperature of the engine cooling water detected by the temperature sensor and external air temperature is equal to or more than a predetermined value.

According to the present invention having the above features, the thermostat monitor functions to detect the open failure of the thermostat based on the temperature of the engine cooling water detected by the temperature sensor positioned in the vicinity of the outlet of the in-engine cooling water channel, to determine that an open failure of the thermostat has occurred when a condition is met such that the difference between the temperature of the engine cooling water and the temperature of the external air is equal to or more than the predetermined value, (specifically, the state where the cooling effect on the engine cooling water by the radiator is sufficiently larger than the cooling effect on the engine cooling water by the heater core). Thus, in the present invention, it is possible to distinguish the state where the temperature of the engine cooling water is decreased by the open failure of the thermostat, and the state where the temperature of the engine cooling water is decreased by the heat radiation of the heater core relatively easily, and thus, it is possible to detect the open failure of the thermostat with certainty.

According to the present invention, preferably, the thermostat monitor further comprises a thermostat open failure detecting part for detecting an occurrence of the open failure of the thermostat when a condition is met such that a radiator heat radiation amount radiated from the radiator on the radiator-side cooling water channel is larger than a heater core heat radiation amount radiated from the heater core on the heater core-side cooling water channel, and that a difference between the radiator heat radiation amount and the heater core heat radiation amount is equal to or more than a predetermined value, wherein the thermostat open failure detecting part starts the detection when the condition for the temperature difference determining part is met.

According to the present invention having the above features, in the thermostat monitor for detecting the open failure of the thermostat based on the temperature of the engine cooling water detected by the temperature sensor positioned in the vicinity of the outlet of the in-engine cooling water channel, it is possible for the thermostat open failure detecting part to distinguish that, among the state where a decrease in the temperature of the engine cooling water is caused by the heat radiation of the heater core, and the state where a decrease in the temperature of the engine cooling water is caused by the open failure of the thermostat, the latter (the state where a decrease in the temperature of the engine cooling water is caused by the open failure of the thermostat) has occurred, under a situation wherein the condition for the temperature difference determining part is met, and the cooling effect on the engine cooling water by the radiator is sufficiently larger than the cooling effect on the engine cooling water by the heater core, and thus, it is possible to detect the open failure of the thermostat relatively easily with more certainty.

According to the present invention, preferably, the thermostat monitor further comprises a vehicle speed determining part for having the thermostat open failure detecting part start the detection when a condition is met such that vehicle speed is equal to or more than a predetermined vehicle speed, wherein the predetermined vehicle speed is set such that a relationship is established such that the radiator heat radiation amount becomes larger than the heater core heat radiation amount, and that the difference between the radiator heat radiation amount and the heater core heat radiation amount becomes equal to or more than the predetermined value, wherein the thermostat open failure detecting part starts the detection when the condition for the temperature difference determining part is met, and the condition of the vehicle speed determining part is met.

According to the present invention having the above features, the thermostat monitor functions to detect the open failure of the thermostat based on the temperature of the engine cooling water detected by the temperature sensor positioned in the vicinity of the outlet of the in-engine cooling water channel, so that, when the vehicle speed determining part determines that the relationship is established such that the radiator heat radiation amount which is increased as the vehicle speed is increased, is larger than the heater core heat radiation amount which is maintained substantially constant with respect to a change in the vehicle speed, and that the difference between the radiator heat radiation amount and the heater core heat radiation amount is equal to or more than the predetermined value, and in addition, when the temperature difference determining part determines that the cooling effect on the engine cooling water by the radiator is sufficiently larger than the cooling effect on the engine cooling water by the heater core, it is possible for the thermostat open failure detecting part to determine that, among the state where a decrease in the temperature of the engine cooling water is caused by the heat radiation of the heater core, and the state where a decrease in the temperature of the engine cooling water is caused by the open failure of the thermostat, there is occurring a decrease in the temperature of the engine cooling water due to the open failure of the thermostat, and thus, it is possible to detect the open failure of the thermostat relatively easily with more certainty.

Meritorious Effect of Invention

According to the thermostat monitor of the present invention, it is possible to detect the open failure of the thermostat relatively easily with certainty based on the temperature of the engine cooling water detected by the temperature sensor positioned in the vicinity of the outlet of the in-engine cooling water channel.

DETAILED DESCRIPTION

With reference to the accompanying drawings, a thermostat monitor according to one embodiment of the present invention will now be described.

Figure 1:
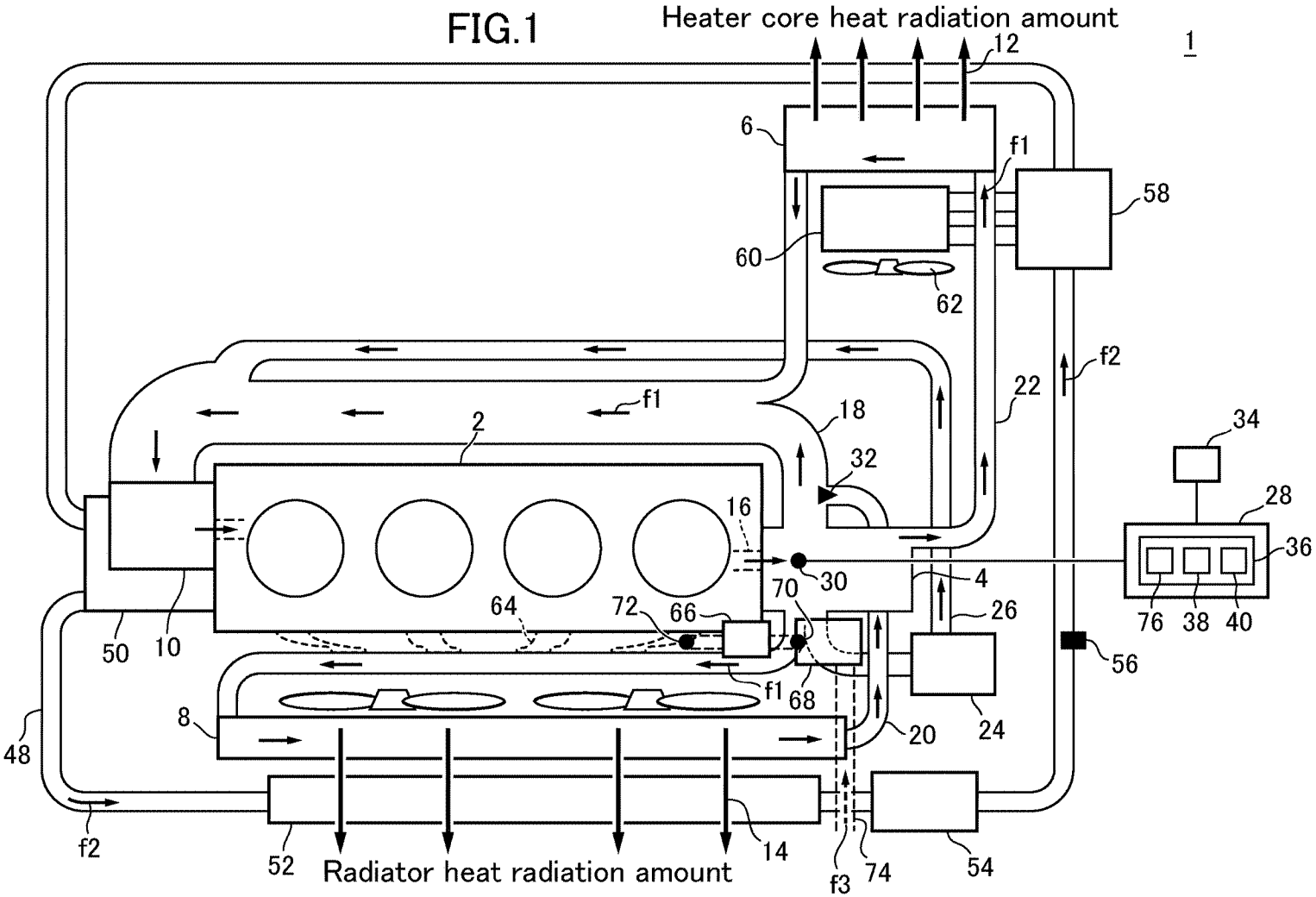
FIG. 1 is a schematic diagram of a configuration of an engine cooling system to which a thermostat monitor according to one embodiment of the present invention is applied.

FIG. 1 is a schematic diagram of a configuration of an engine cooling system to which a thermostat monitor according to one embodiment of the present invention is applied. In FIG. 1, the flow of engine cooling water inside an engine cooling water channel system 4 is illustrated by an arrow f1, the flow of coolant inside a coolant circulation channel 48 is illustrated by an arrow f2, and the flow of external air flowing into an external air inlet 74 is illustrated by an arrow f3.

An engine cooling system 1 for cooling an engine 2 of a vehicle comprises an engine cooling water channel system 4 for having the engine cooling water flown out from the engine 2 circulated within the engine cooling water channel system 4 and returned to the engine; a heater core 6 for making use of heat of the engine cooling water flowing inside the engine cooling water channel system 4 for heating; a radiator 8 for radiating heat of the engine cooling water flowing inside the engine cooling water channel system 4 to the external air; and a water pump 10 for pumping the engine cooling water inside the engine cooling water channel system 4. The engine 2, the heater core 6, the radiator 8 and the water pump 10 are positioned on the engine cooling water channel system 4.

The heater core 6 is embodied as a heat exchanger for radiating heat of the engine cooling water for use in vehicle room heating, and constitutes a part of an air conditioning heater (not shown) for supplying warm air into an interior room of the vehicle. In the heater core 6, even under a state where an user has made a setting of heating to a most powerful position such that an amount of heat radiation of the engine cooling water becomes the maximum, an amount of heat radiation of the heater core 6 (heater core heat radiation amount 12) is of a relatively low value, and the amount of heat radiation is kept as a generally fixed maximum value at this point of time.

The radiator 8 is a heat exchanger for effecting heat exchange between the engine cooling water and cooling wind supplied to a surface of the radiator 8 in order to radiate heat of the engine cooling water. The amount of supply of the cooling wind is increased as vehicle speed of the vehicle is increased (at high speed), so that the amount of heat radiation of the radiator 8 (the radiator heat radiation amount 14) is accordingly increased.

The water pump 10 comprises a structure which operates in response to an increase in engine speed of the engine 2 for pressurizing and pumping the engine cooling water. Thus, when the engine speed of the engine 2 is increased, the flow rate of the engine cooling water is increased, so that a flow rate of the passing water of the engine cooling water to the radiator 8 is increased and the radiator heat radiation amount 14 is increased. Also, the flow rate of passing water of the engine cooling water to the heater core 6 is increased. On the other hand, when the engine speed of the engine 2 is decreased, the flow rate of the engine cooling water is decreased, so that the flow rate of the passing water of the engine cooling water to the radiator 8 is decreased.

The engine cooling system 1 further comprises the coolant circulation channel 48 through which the coolant circulates; a compressor 50 for compressing and feeding coolant gas under pressure; a condenser 52 for taking latent heat from the coolant gas fed from the compressor 50 to make coolant liquid into high temperature and high pressure state; a receiver drier 54 for temporarily retaining the coolant liquid; a coolant pressure sensor 56 for detecting coolant pressure of the coolant on the coolant circulation channel 48; an expansion valve 58 for depressurizing the coolant liquid to convert it into a gas-liquid mixture type coolant in the state of low temperature and low pressure; an evaporator 60 for cooling the air passing inside the evaporator 60 through a heat exchange with the coolant; and a blower 62 for introducing external air or internal air into an air channel (not shown) provided in the body of the air conditioner to deliver the introduced air downward (to a downstream side).

The evaporator 60 is positioned downstream of the blower 62, and the air delivered from the blower 62 passes the interior portion of the evaporator 60. The heater core 6 is positioned downstream of the evaporator 60, and the cool wind which has been produced by being passed through the evaporator 60 is then passed through the inside portion of the heater core 6.

Next, description will be made on the engine cooling water channel system 4 in further detail.

The engine cooling water channel system 4 comprises an in-engine cooling water channel 16 provided inside the engine 2; a cooling water circulation channel 18; a radiator-side cooling water channel 20; a heater core-side cooling water channel 22; and an ATF warmer-side cooling water channel 26. Engine cooling water discharged from an outlet of the in-engine cooling water channel 16 (hereinafter referred as "engine-discharged cooling water") is branched a plurality of branch channels to pass through respective ones of the cooling water circulation channel 18, the radiator-side cooling water channel 20, the heater core-side cooling water channel 22, and the ATF warmer-side cooling water channel 26, and thereafter, returned back to the in-engine cooling water channel 16 from the cooling water circulation channel 18.

The cooling water circulation channel 18 is arranged to return the engine-discharged cooling water to an inlet of the in-engine cooling water channel 16. The radiator-side cooling water channel 20 is arranged to guide the engine-discharged cooling water to the radiator 8. The heater core side cooling channel 22 is arranged to guide the engine-discharged cooling water to the heater core 6. The ATF warmer-side cooling water channel 26 is arranged to guide the engine-discharged cooling water to an ATF warmer 24 for the hydraulic oil of the automatic transmission (ATF).

The ATF warmer-side cooling water channel 26 has a downstream end which is connected to the vicinity of the downstream end of the cooling water circulation channel 18. In the present embodiment, it can be assumed that the heat radiation in the ATF warmer-side cooling water channel 26 does not have any effect on calculation of the amount of heat radiation described in the followings.

The engine cooling system 1 further comprises an intake manifold 64 for taking external air into each of combustion chambers of respective ones of cylinders (not shown) of the engine 2; a throttle valve body 66 provided upstream (external air inlet side) of the intake manifold 64; air cleaner 68 provided upstream (external air inlet side) of the throttle valve body 66; and the external air inlet 74 connected to the air cleaner 68 for introducing external air into the air cleaner 68.

In addition, the engine cooling system 1 comprises a powertrain control module (PCM) 28; a temperature sensor 30 positioned in the vicinity of the outlet of the in-engine cooling water channel 16 for detecting temperature of the engine cooling water; a thermostat 32 provided on the radiator-side cooling water channel 20; a vehicle speed sensor 34 for detecting vehicle speed of the vehicle; a first external air temperature sensor 70 provided on a flow path upstream of (external air inlet side) the throttle valve body 66; and a second external air temperature sensor 72 provided in the flow path of the intake manifold 64.

The PCM 28 comprises an input interface (not shown) for receiving data sent from a plurality of units of the vehicle; a CPU (not shown) for executing computation to perform controls of the plurality of units of the vehicle; a memory (not shown) for storing programs, data and control signals to perform controls of the plurality of units of the vehicle; and an interface (not shown) for sending control signals to the plurality of units of the vehicle.

The program for realizing the thermostat monitor of the present invention, and data and tables used for executing such program are stored on the memory. In addition, the memory is provided with a workspace for the computation by the CPU, and the data sent from the plurality of units of the vehicle and the control signals to be sent to the plurality of units of the vehicle are stored in the memory. The PCM 28 constitutes a thermostat monitor 36 for detecting the open failure of the thermostat 32. The thermostat monitor 36, functionally, comprises a thermostat open failure detecting part 38; a vehicle speed determining part 40; and a temperature difference determining part 76.

The temperature sensor 30 is positioned in a region downstream of the in-engine cooling water channel 16, upstream of the radiator-side cooling water channel 20 and upstream of the heater core-side cooling water channel 22, and detects temperature of the engine-discharged cooling water. The temperature sensor 30 and the PCM 28 are electrically connected, and the temperature of the engine-discharged cooling water detected by the temperature sensor 30 is input to the PCM 28 in the form of an electrical signal.

The thermostat 32, in accordance with the present embodiment, is comprised of a changeover valve of a mechanical detection type using a bimetal or the like. It should be noted that the thermostat 32 may have a function to control the flow of water through the radiator-side cooling water channel 20, and for example, it may be configured by a changeover valve of an electric detection type using a thermistor or the like. Also, it may be configured by a water flow controlling valve of an electrically operated type which is opened and closed by an electrical control based on such as temperature conditions for controlling water flow. Further, the thermostat 32 is shown as being provided at the outlet side (downstream) of the radiator 8 on the radiator-side cooling water channel 20, but it may be provided at the inlet side (upstream) of the radiator 8, for example.

Thermostat 32 is configured such that the valve is closed to close the radiator-side cooling water channel 20 when the temperature of the engine cooling water is lower than a predetermined temperature. This operation may block a flow of the cooling water which is to be passed through the radiator-side cooling water channel 20 for heat radiation by the radiator 8. When the thermostat 32 is held in a closed state, the engine-discharged cooling water is not supplied to the radiator 8. Thus, the engine-discharged cooling water is supplied to the heater core 6 through the heater core-side cooling water channel 22 or supplied to the cooling water circulation channel 18 or the like, and thereafter returned to the in-engine cooling water channel 16. Therefore, when the thermostat 32 is in the closed state, the engine-discharged cooling water does not pass through the radiator-side cooling water channel 20, and not cooled by heat radiation of the radiator 8.

On the other hand, the thermostat 32 is configured such that the valve is opened to open the radiator-side cooling water channel 20 when the temperature of the engine cooling water is equal to or higher than the predetermined temperature. This operation may allow the flow of the cooling water through the radiator-side cooling water channel 20 for heat radiation by the radiator 8. At this point, the engine-discharged cooling water of high temperature flows into the radiator-side cooling water channel 20. Therefore, when the thermostat 32 is in an open state, after the engine-discharged cooling water of high temperature is cooled at the radiator 8, it is returned to the cooling water circulation channel 18 downstream of the temperature sensor 30, and then returned to the in-engine cooling water channel 16 again. When the thermostat 32 is in the open state, the engine-discharged cooling water passes through the radiator 8, and thus, the engine-discharged cooling water is cooled through heat radiation by the radiator heat radiation amount 14.

The vehicle speed sensor 34 functions to detect vehicle speed. The vehicle sensor 34 and the PCM 28 are electrically connected, and the vehicle speed detected by the vehicle speed sensor 34 is input to the PCM 28 in the form of an electrical signal.

The first external air temperature sensor 70 functions to detect the temperature of outside air (external air) of the vehicle to be drawn into the air cleaner 68 in the vicinity of the air cleaner 68 upstream of the throttle valve body 66. The first external air temperature sensor 70 and the PCM 28 are electrically connected, and the external air temperature detected by the first external air temperature sensor 70 is input to the PCM 28 in the form of an electrical signal.

The second external air temperature sensor 72 functions to detect the temperature of the outside air (external air) of the vehicle drawn into the engine 2 in the flow path of the intake manifold 64. The second external air temperature sensor 72 and the PCM 28 are electrically connected, and the external air temperature detected by the second external air temperature sensor 72 is input to the PCM 28 in the form of an electrical signal.

The first external air temperature sensor 70 and the second external air temperature sensor 72 measure the external air temperature in the vicinity of the radiator 8 (ambient temperature of the radiator 8). Thus, the external air temperature flowing into the radiator 8 and the external air temperature measured by the first external air temperature sensor 70 and/or the second external air temperature sensor 72 are approximately of the same value.

In the present embodiment, the first external air temperature sensor 70 and the second external air temperature sensor 72 are shown as the example of the external air temperature sensors positioned in the vicinity of the radiator 8, but the external air temperature sensor may be located at another position in the vicinity of the radiator 8. For example, the external air temperature sensor may be provided upstream of the radiator 8 in a pathway of a supply wind supplied to the surface of the radiator 8. In addition, either only one of the first external air temperature sensor 70 or the second external air temperature sensor 72 may be provided.

Next, description will be made on the thermostat monitor 36 of the present embodiment.

The thermostat monitor 36 of the present embodiment is designed to detect the open failure of the thermostat 32 provided on the radiator-side cooling water channel 20 based on the temperature of the engine-discharged cooling water (hereinafter referred as "engine outlet water temperature") detected by the single temperature sensor 30 positioned in the outlet-region of the in-engine cooling water channel 16 included in the engine cooling water channel system 4.

The thermostat monitor 36 functions to distinguish the decrease in the temperature of the engine cooling water as to whether the decrease is caused by the heat radiation of the heater core 6 or the open failure of the thermostat 32 based on the engine outlet water temperature, at the time when the engine 2 is in a cold state, that is, when the temperature of the engine cooling water is lower than a predetermined temperature which is determined as a temperature above which the valve of the thermostat 32 is to be opened, to thereby make it possible to detect the open failure of the thermostat 32 with certainty. Specifically, when the engine 2 is in the cold state, the valve of the thermostat 32 shall not naturally be opened, but due to the open failure of the thermostat 32, there may be a case where the valve of the thermostat 32 is held open even though the engine is in the cold state. In this case, the engine cooling water flown out from the engine 2 passes through the radiator-side cooling water channel 20 and cooled by the radiator 8, so that the temperature of the engine cooling water after the engine start becomes lower as compared to the predicted water temperature of the engine cooling water when the thermostat 32 is in a normal operation (when it is not in failure) (refer to FIG. 4).

Figure 6:
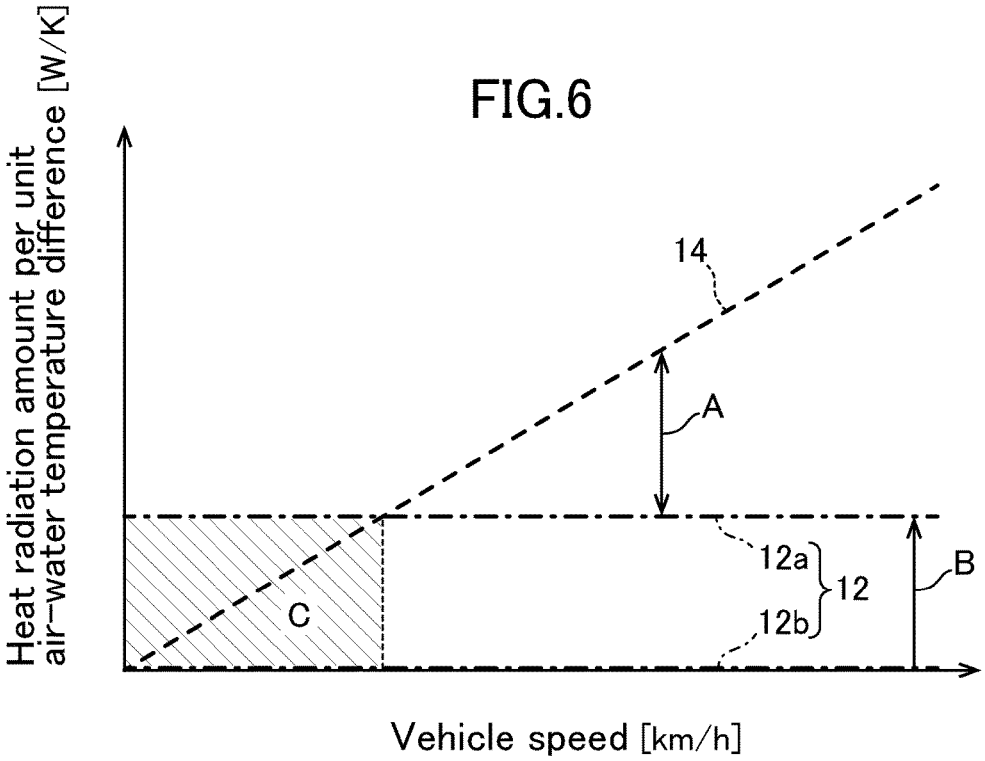
FIG. 6 is an illustration depicting a heat radiation characteristic of a radiator heat radiation amount and a heater core heat radiation amount with respect to vehicle speed according to one embodiment of the present invention.

The thermostat open failure detecting part 38 is designed to detect the occurrence of the open failure of the thermostat 32 when a condition is met such that the radiator heat radiation amount 14 is larger than the heater core heat radiation amount 12, and a difference between the radiator heat radiation amount 14 and the heater core heat radiation amount 12 is equal to or more than a predetermined value A (refer to FIG. 6).

The vehicle speed determining part 40 is configured to start the detection by the thermostat open failure detecting part 38 when a condition is met such that the vehicle speed is equal to or more than a predetermined vehicle speed V1. The predetermined vehicle speed V1 is the vehicle speed at which the relationship is established such that the radiator heat radiation amount 14 is larger than the heater core heat radiation amount 12, and the difference between the radiator heat radiation amount 14 and the heater core heat radiation amount 12 is equal to or more than the predetermined value A.

The temperature difference determining part 76 is configured to start the detection of the open failure of the thermostat 32 when a condition is met such that a temperature difference between the detected water temperature 44 of the engine cooling water detected by the temperature sensor 30 and the external air temperature 46 is equal to or more than a predetermined value F. It should be noted that, under the state where the condition is such that the temperature difference between the detected water temperature 44 and the external air temperature 46 is equal to or more than the predetermined value F, the cooling effect to the engine cooling water by the radiator 8 is sufficiently larger than the cooling effect to the engine cooling water by the heater core 6, and thus, it is possible to detect the open failure of the thermostat relatively easily even with the temperature determining part 76 only.

Next, description will be made on details of operations and process contents of the thermostat monitor 36 of the present embodiment taking reference to FIGS. 2 to 6.

Figure 2:
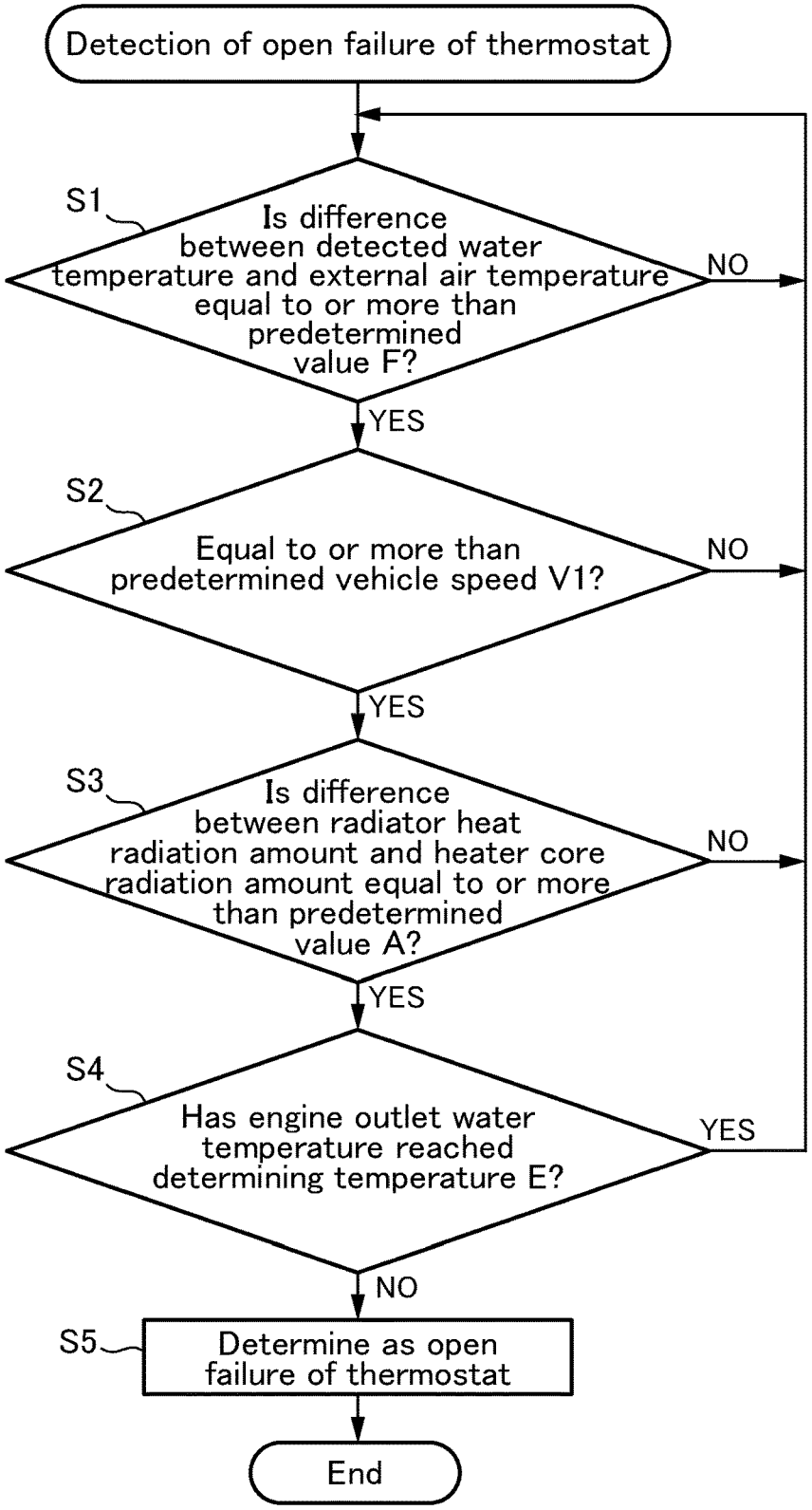
FIG. 2 is a flow chart depicting a process procedure of detecting an open failure of a thermostat by the thermostat monitor according to one embodiment of the present invention.
Figure 3:
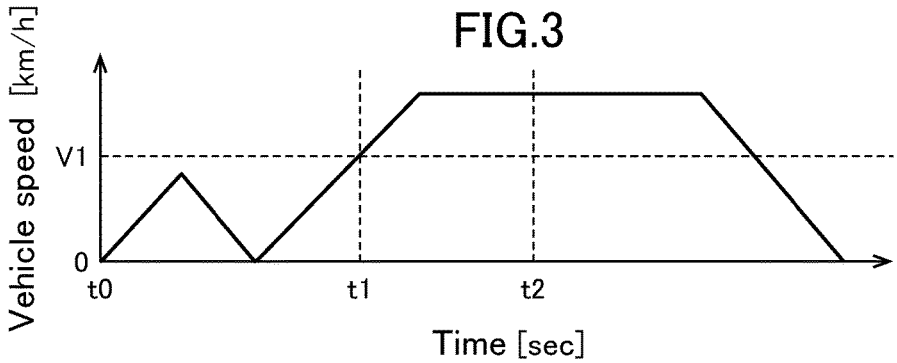
FIG. 3 is an illustration depicting one example of change by time of vehicle speed from the engine start according to one embodiment of the present invention.
Figure 4:
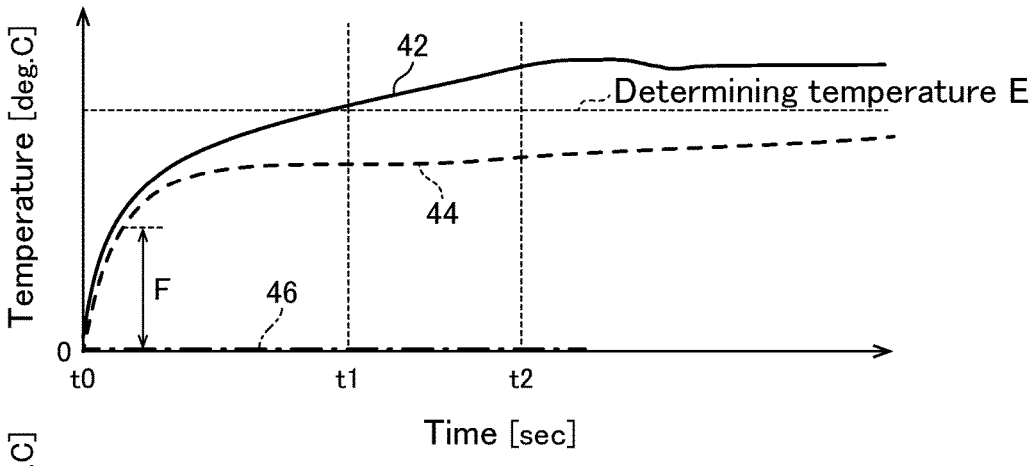
FIG. 4 is an illustration depicting change by time of a predicted water temperature of engine cooling water when a thermostat is in a normal operation (not in failure), and a detected water temperature of engine cooling water actually measured when a thermostat is in open failure according to one embodiment of the present invention.
Figure 5:
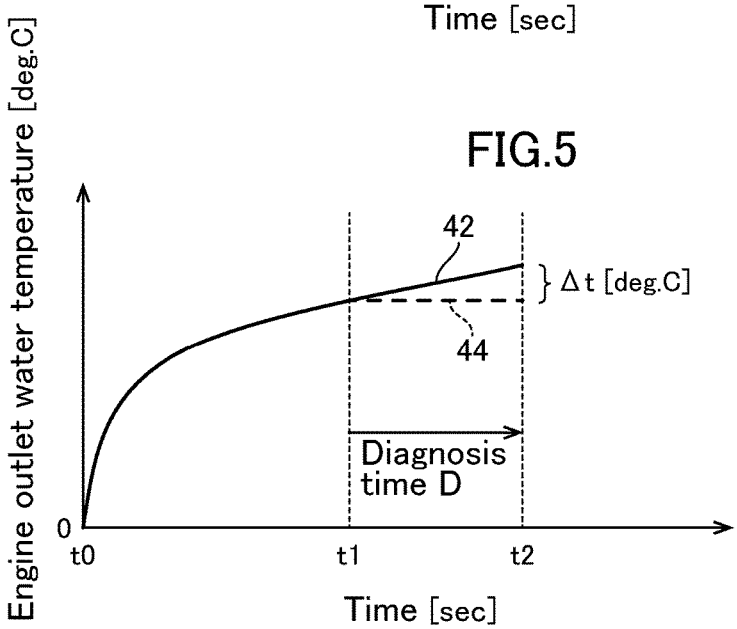
FIG. 5 is an illustration depicting that a temperature difference is produced during a diagnostic period between the predicted water temperature of engine cooling water with the thermostat in the normal operation (not in failure) and the detected water temperature of engine cooling water actually measured when the thermostat is in open failure.

FIG. 2 is a flowchart depicting the process procedure of detecting the open failure of the thermostat by the thermostat monitor, FIG. 3 is an illustration depicting one example of change by time of vehicle speed from the start of engine start, FIG. 4 is an illustration depicting change by time of the predicted water temperature of engine cooling water when the thermostat is in the normal operation (not in failure), and the detected water temperature of engine cooling water actually measured when the thermostat is in open failure, FIG. 5 is an explanatory illustration depicting that a temperature difference is produced during a diagnostic period between the predicted water temperature of engine cooling water with the thermostat in the normal operation (not in failure) and the detected water temperature of engine cooling water actually measured when the thermostat is in open failure, and FIG. 6 is an illustration depicting a heat radiation characteristic of the radiator heat radiation amount and the heater core heat radiation amount with respect to the vehicle speed.

As shown in FIG. 2, in step S1, the temperature difference determining part 76 of the thermostat monitor 36 allows a start of detecting the open failure of the thermostat 32 when the condition is such that the difference between the detected temperature 44 and external air temperature 46 is equal to or more than the predetermined value F (S1; Yes).

FIG. 4 shows a change in the predicted water temperature 42 of the engine cooling water in normal operating condition (not in failure) of the thermostat 32 and that in the actually detected water temperature 44 of the engine cooling water in the condition of open failure of the thermostat 32, the changes being shown from the time t0 at the start of engine 2. In addition, FIG. 4 shows a change in the external air temperature measured by the first external air temperature sensor 70 and/or the second external air temperature sensor 72. The vertical axis of FIG. 4 shows temperature [deg.C.] (degrees in Celsius), and the horizontal axis shows elapsed time [sec] from the point of time t0 at the start of engine.

In the present embodiment, the external air temperature 46 measured by the first external air temperature sensor 70 and/or the second external air temperature sensor 72 is a lower temperature value selected from the detected temperature by the first external air temperature sensor 70 and the detected temperature by the second external air temperature sensor 72. Alternatively, depending on another condition, either one of the temperature detected by the first external air temperature sensor 70 or the temperature detected by the second external air temperature sensor 72 may be adopted, and also, a mean temperature value of both temperatures can be provided as the external air temperature 46.

As shown in FIG. 4, the external air temperature 46 is generally constant during a relatively short period from the time t0 at the start of engine 2. In addition, after the time t0, the difference between the detected water temperature 44 and the external air temperature 46 gradually increases. Thus, when the vehicle speed is increased or when the engine 2 is warmed up after the engine start, for example, the detected water temperature 44 of the engine cooling water is increased, and the difference between the detected water temperature 44 and the external air temperature 46 becomes larger. Therefore, the cooling effect on the engine cooling water by the radiator 8 becomes larger. On the other hand, the cooling effect on the engine cooling water by the heater core 6 is generally constant even if the difference between the detected temperature 44 and the external air temperature 46 is increased in response to the increase of the vehicle speed, for example.

Therefore, in a state where the difference between the detected water temperature 44 and the external air temperature 46 is equal to or greater than the predetermined value F, the cooling effect on the engine cooling water by the radiator 8 is sufficiently larger than the cooling effect on the engine cooling water by the heater core 6. Specifically, detection of open failure of the thermostat 32 is performed under the condition that the temperature decrease in the engine cooling water during the open failure of the thermostat 32 (the temperature decrease due to the heat radiation of the radiator 8) becomes sufficiently large as compared with the temperature decrease in the engine cooling water due to the heat radiation of the heater core 6.

In addition, as shown in FIG. 4, when the condition is such that the difference between the detected water temperature 44 and the external air temperature 46 is equal to or more than the predetermined value F, the difference between the predicted water temperature 42 described below and the detected water temperature 44 will become relatively large. Thus, the thermostat open failure detecting part 38 can determine the failure with higher accuracy and certainty.

Thus, when the condition is such that the difference between the detected temperature 44 and the external air temperature 46 is equal to or more than the predetermined value F (S1; Yes), the temperature difference determining part 76 determines that, among the state where the temperature of the engine cooling water is decreased due to the open failure of the thermostat 32 and the state where the temperature of the engine cooling water is decreased due to the heat radiation of the heater core 6, the former (the state where the temperature of the engine cooling water is decreased due to the open failure of the thermostat 32) is dominant, and proceeds to step S2 to have the detection of the open failure of the thermostat 32 started.

On the other hand, when the condition is not such that the temperature difference between the detected temperature 44 and the external air temperature 46 is equal to or more than the predetermined value F (S1; No), the temperature difference determining part 76 determines that it is in a state wherein it is difficult to distinguish the state where the temperature of the engine cooling water is decreased due to the open failure of the thermostat 32, from the state where the temperature of the engine cooling water is decreased due to the heat radiation of the heater core 6, and the process is returned to the step S1 to continue the process for detecting the open failure of the thermostat 32 with more certainty.

In the step S2, the vehicle speed determining part 40 of the thermostat monitor 36 determines as to whether the vehicle speed of the vehicle is equal to or more than the predetermined vehicle speed V1 after the point of time t0 when the engine 2 is started. When the vehicle speed of the vehicle is increased to a value equal to or larger than the predetermined speed V1 (for example, equal to or more than 50 km/hour) (S2; Yes), it can be assumed that the condition is such that the radiator heat radiation amount 14 is larger than the heater core heat radiation amount 12, and that the difference between the radiator heat radiation amount 14 and the heater core heat radiation amount 12 is equal to or more than the predetermined value A, and thus, the process proceeds to step S3.

On the other hand, when the speed of the vehicle is less than the vehicle speed V1 (for example, less than 50 km/hour) (S2; No), it can be assumed that it may often be the case wherein the condition is not such that the radiator heat radiation amount 14 is larger than the heater core heat radiation amount 12, and that the difference between the radiator heat radiation amount 14 and the heater core heat radiation amount 12 is equal to or more than the predetermined value A (for example, the radiator heat radiation amount 14 is smaller than the heater core heat radiation amount 12), and thus, the process returns to the step S1 again.

As described above, in the present embodiment, the vehicle speed determining part 40 can perform the determination as to whether the detection by the thermostat open failure detecting part 38 shall be started taking the vehicle speed V1 as a reference.

FIG. 3 shows one example of a change in the vehicle speed after the point of time t0 at the engine start. The vertical axis of FIG. 3 shows vehicle speed [km/h], and the horizontal axis shows elapsed time [sec] from the point of time t0 at the start of the engine 2. As shown in FIG. 3, at the point of time t1, the vehicle speed becomes a value equal to or more than the vehicle speed V1, so that the process proceeds to the step S3.

The vehicle speed V1 is the one under which there is a high possibility of producing a following relationship when the vehicle speed of the vehicle reaches or exceeds the vehicle speed V1. Specifically, when the vehicle speed of the vehicle is equal to or more than the vehicle speed V1, the radiator heat radiation amount 14 calculated by a predetermined method shows a larger value than the heater core heat radiation amount 12, and the difference between the radiator heat radiation amount 14 and the heater core heat radiation amount 12 becomes equal to or more than the predetermined value A due to a difference between respective radiation characteristics of the radiator 8 and the heater core 6 as shown in FIG. 6. The vehicle speed V1 is generally determined such that the aforementioned relationship will be established. Therefore, when the vehicle runs at a speed equal to or more than the vehicle speed V1, the radiator heat radiation amount 14 becomes larger than the heater core heat radiation amount 12, and the difference between the radiator heat radiation amount 14 and the heater core heat radiation amount 12 becomes equal to or more than the predetermined value A.

Further, in the present embodiment, the procedure is such that, after the step S1, when it is determined that the predetermined condition is met in the step S2, the detection by the thermostat open failure detecting part 38 is started in the step S3. However, in an alternative embodiment, the step S2 may be executed independent of the step S1 to execute the step S3 when both conditions of the steps S1 and S2 are established. In this case, the respective determining processes of the steps S1 and S2 can be performed substantially simultaneously in parallel, or may be performed independently with timings before and after each other.

In addition, in the present embodiment, the step S1 is executed in the process flow shown in FIG. 2, but the process may be such that the step S1 is not carried out.

In the step S3, the vehicle speed determining part 40 functions to make the thermostat open failure detecting part 38 start the detection. In this procedure, the thermostat open failure detecting part 38, first of all, computes the predicted water temperature 42 of the engine-discharged cooling water when the thermostat 32 is in the normal operation (when it is not in failure).

In the step S3, as shown in FIG. 5, at the point of time t1, the thermostat open failure detecting part 38 starts computing variation of the predicted water temperature 42 of the engine-discharged cooling water for a predetermined period of time (diagnosis time D from the point of time t1 to a point of time t2). The vertical axis of FIG. 5 shows the water temperature [deg.C.] of the engine-discharged cooling water, and the horizontal axis shows the elapsed time [sec] from the point of time t0 at the start of engine 2. Such computation of the predicted water temperature 42 is determined by various setting factors of parameters. Further, the computation of the predicted water temperature 42 can be performed for a longer time including the diagnosis time D. Data necessary for computing the predicted water temperature 42 is acquired in advance in the memory of the PCM 28 and/or newly acquired.

Further, description will be made on a process for calculating heat radiation amount from the temperature difference between the computed predicted water temperature 42 and the actually detected water temperature 44 with reference to FIG. 5.

As shown in FIG. 5, the temperature difference between the computed predicted water temperature 42 and the actually detected water temperature 44 is produced during the diagnosis time D from the point of time t1 to the point of time t2.

The predicted water temperature 42 of the engine-discharged cooling water during the diagnosis time D from the point of time t1 to the point of time t2 is calculated by the thermostat open failure detecting part 38 based on various design conditions assuming that the thermostat 32 is normally operating. In FIG. 5, it is assumed that the thermostat 32 is normally operating (specifically, it is assumed that there is no heat radiation of the radiator 8), and the predicted water temperature 42 is being increased.

On the contrary, the detected water temperature 44 during the diagnosis time D from the point of time t1 to the point of time t2 is the temperature of the engine-discharged cooling water actually detected by the temperature sensor 30 from the point of time t1 when the vehicle speed became equal to or more than the vehicle speed V1 to the point of time t2 when the diagnosis time D is elapsed.

As shown in FIGS. 4 and 5, when the open failure of the thermostat 32 has happened, because of the heat radiation amount of the radiator 8, the detected water temperature 44 becomes lower than the predicted water temperature 42. Therefore, when there is an open failure in the thermostat 32, the temperature difference Δt [deg.C.] between the detected water temperature 44 and the predicted water temperature 42 will be detected. On the contrary, when there is no open failure in the thermostat 32, there will be no heat radiation from the radiator 8, the detected water temperature 44 and the predicted water temperature 44 generally match with each other.

By using such temperature difference Δt, the amount of heat radiation Q of the radiator 8 (radiator heat radiation amount 14) can be determined by the following formula.

Temperature difference $\Delta t$ [deg.C.]×Radiator water flow amount [$m^3$]×Specific heat [J/kgK]×Density [$kg/m^3$]=Amount of heat radiation $Q$ [J]

Dividing the amount of heat radiation Q [J] by a mean value of air-water temperature difference during the diagnosis time D, it is possible to determine the amount of heat radiation Q [W/K] per unit air-water temperature difference.

Here, the radiator water flow amount [$m^3$] is determined mainly in accordance with the discharge pressure of the water pump (specifically, engine speed). The specific heat [J/kgK] is the specific heat of the engine cooling water. The density [$kg/m^3$] is the density of the engine cooling water. The air-water temperature difference is the temperature difference between the engine cooling water and the cooling air. The diagnosis time D is determined taking into account factors such as delay time of transferring the radiator heat radiation amount 14 and time constant of the temperature sensor 30.

In FIG. 6, there is shown a relationship of the radiator heat radiation amount 14, the heater core heat radiation amount 12 and the vehicle speed calculated by the above computation using the temperature difference Δt between the detected water temperature 44 and the predicted water temperature 42 (relationship of the heat radiation characteristic). The vertical axis of FIG. 6 shows the heat radiation amount per unit air-water temperature difference [W/K], and the horizontal axis shows the vehicle speed [km/h].

While the radiator heat radiation amount 14 is increased relatively linearly with respect to the increase of the vehicle speed, the heater core heat radiation amount 12 is kept generally constant with respect to the increase of the vehicle speed. The heater core heat radiation amount 12 differs in accordance with an ON/OFF setting of the heater, the setting of heater power when the heater is ON, number of stages of the blower, and other capabilities of respective products of the blower, or the like. In FIG. 6, the heater core heat radiation amount 12*a* shows the heater core heat radiation amount in a setting where an air conditioner is used, and power and temperature of the heater are set at the maximum. On the other hand, the heater core heat radiation amount 12*b* shows the heater core heat radiation amount in a setting where the heater is OFF. Specifically, the value of the heat radiation amount 12 is determined by settings of the heater and the blower 62, etc., and does not change along with increase and/or decrease of the vehicle speed, as shown in an arrow B in FIG. 6. Such information of the heater core heat radiation amount 12 is stored in advance in the memory on the PCM 28 side, but it may be determined by information from sensors or the like. In the present embodiment, for example, the heater core heat radiation amount 12*a* in the setting where the air conditioner is used and power of the heater is set at the maximum, is used as the heater core heat radiation amount 12 to calculate the heat radiation amount difference as described below.

A vehicle speed zone C (refer to FIG. 6) which has a possibility that the radiator heat radiation amount 14 is lower than the heater core heat radiation amount 12 has already been made out of consideration by the vehicle speed determining means 40 in the step S2 (S2; Yes). Therefore, in the step S3, when the difference between the radiator heat radiation amount 14 and the heater core heat radiation amount 12 is equal to or more than the threshold value of the predetermined value A (for, example equal to or more than 200 W/K), it is determined that the state is such that the amount of heat radiation at the radiator 8 is largely beyond the amount of heat radiation at the heater core 6, and it is possible to diagnose that the possibility of the open failure of the thermostat 32 is high.

Therefore, when the difference between the radiator heat radiation amount 14 and the heater core heat radiation amount 12 is equal to or more than the threshold value of the predetermined value A (for example, equal to or more than 200 W/K) (S3; Yes), the process proceeds to step S4. Further, in order to improve reliability for detecting the open failure of the thermostat 32, it is possible to return to the step S1 repeatedly, during a predetermined period of time, to perform the processing again, until number of times that the difference between the radiator heat radiation amount 14 and the heater core heat radiation amount 12 becomes equal to or more than the threshold value of the predetermined value A reaches a predetermined number of times (for example, three times), and then proceed to the step S4 after the predetermined number of times is reached.

On the other hand, when the difference between the radiator heat radiation amount 14 (calculated from the temperature difference between the predicted water temperature 42 and the detected water temperature 44) and the heater core heat radiation amount 12 is less than the threshold value of the predetermined value A (for example, less than 200 W/K) (S3; No), the condition of the vehicle speed is met, but the amount of heat radiation at the radiator 8 is not sufficiently beyond the amount of heat radiation at the heater core 6, so that the process returns to the step S1 in order to detect the open failure of the thermostat 32 with more certainty.

Further, in the step S3, it is to be noted that the thermostat monitor 36 comprises a vehicle speed maintenance determining function for determining as to whether the vehicle speed of the vehicle is maintained at a value equal to or more than the vehicle speed V1 during the diagnosis time D. Specifically, for performing an arithmetic processing for calculating the radiator heat radiation amount 14 from the temperature difference between the predicted water temperature 42 and the detected temperature 44, it is required that the vehicle speed is maintained at the value equal to or more than the vehicle speed V1 for a predetermined time from the point of time t1 when the vehicle speed became equal to or more than the vehicle speed V1 to the point of time t2 when the predetermined diagnosis time D has elapsed.

Therefore, the thermostat monitor 36 calculates the radiator heat radiation amount 14 based on the temperature difference Δt determined at the point of time t2 which is when the diagnosis time D has elapsed in a case where the vehicle speed of the vehicle is maintained at the value equal to or more than the vehicle speed V1 during the diagnosis time D. Specifically, the thermostat monitor 36 performs the determination as to whether the difference between the radiator heat radiation amount 14 and the heater core heat radiation amount 12 is equal to or more than the threshold value of the predetermined value A in a case where the vehicle speed of the vehicle is maintained at the value equal to or more than the vehicle speed V1 during the diagnosis time D.

On the contrary, the thermostat monitor 36 determines that the running state of the vehicle is not stable (for example, a state such as where the vehicle is being started and stopped repeatedly) when the vehicle speed of the vehicle is not continuously maintained at the value equal to or more than the vehicle speed V1 during the diagnosis time D (for example, in a case where the vehicle speed of the vehicle becomes less than the vehicle speed V1 before passing the diagnosis time D). In this case, the thermostat monitor 36 interrupts the processing by the thermostat open failure detecting part 38 and returns to the step S1 in order to detect the open failure of the thermostat 32 with more certainty.

In the step S4, as shown in FIG. 4, it is determined as to whether the detected water temperature 44 has reached a determining temperature E. The determining temperature E is the temperature such that the thermostat 32 is considered to be normally functioning when the water temperature of the engine-discharged cooling water (engine outlet water temperature) is equal to or more than the determining temperature E, and on the other hand, it is the temperature such that the thermostat 32 is considered to be in the open failure and heat radiation is occurring at the radiator 8 when the engine outlet water temperature is less than the determining temperature E. Specifically, the thermostat monitor 36 comprises a temperature determining function for determining as to whether the detected water temperature 44 has reached the determining temperature E at an appropriate point of time (for example, at the point of time t2) after the diagnosis time D has elapsed.

In a case where the detected temperature 44 has reached the determining temperature E (the detected water temperature 44 is equal to or more than the determining temperature E) (S4; Yes), it is determined that it is in a state where the running state of the vehicle is not stable (for example, the state where the vehicle is being started and stopped repeatedly), and returns to the step S1 in order to detect the open failure of the thermostat 32 with more certainty.

On the other hand, in a case where the detected temperature 44 has not reached the determining temperature E (the detected water temperature 44 is less than the determining temperature E) (S4; No), it is determined that the detected water temperature 44 is being decreased because of a large amount of heat radiation at the radiator 8, and thus determined that the open failure of the thermostat 32 has happened (S5).

Further, in the present embodiment, the thermostat monitor 36 determines as to whether the determining temperature E is reached at the point of time t2, but the thermostat monitor 36 may have a constant temperature determining function for constantly determining as to whether the determining temperature E is reached. In this case, the thermostat monitor 36 may stop the processing of a series of open failure detection when the detected water temperature 44 has reached the determining temperature E and return to the step S1.

In the step S4, after making the determinations in the steps S1 to S3, by determining as to whether the detected water temperature 44 has reached the determining temperature E, it is possible to detect the open failure of the thermostat 32 with certainty based on the detected water temperature 44 while certainly distinguishing between the state where the temperature of the engine cooling water is decreased by heat radiation of the heater core 6, and the state where the temperature of the engine cooling water is decreased by the open failure of the thermostat 32.

In addition, in the present embodiment, it is possible to certainly distinguish the state where the temperature of the engine cooling water is decreased by heat radiation of the heater core 6, and the state where the temperature of the engine cooling water is decreased by the open failure of the thermostat 32, so as to detect the open failure of the thermostat 32 with certainty based on the detected water temperature 44 by omitting the conventionally provided temperature sensor on the radiator-side cooling water channel 20, and using only one temperature sensor 30 for detecting the detected water temperature 44 in the outlet-region region of the in-engine cooling water channel 16, as the temperature sensor inside the engine cooling water channel system 4.

In step S5, when it is determined that the open failure of the thermostat 32 has happened, the processing of the thermostat monitor 36 for detecting the open failure of the thermostat 32 is terminated. When the open failure of the thermostat 32 is detected, the PCM 28 may function to report through a reporting device (not shown) to the user that the open failure of the thermostat 32 has happened, as necessary.

According to the thermostat monitor of the present embodiments, based on the temperature of the engine cooling water detected by the temperature sensor 30 positioned in the vicinity of the outlet of the in-engine cooling water channel 16, the thermostat monitor 36 for detecting the open failure of the thermostat 32 is provided. In such thermostat monitor 36, when the vehicle speed determining part 40 determines that the condition is such that the radiator heat radiation amount 14 radiated from the radiator 8 is larger than the heater core heat radiation amount 12 radiated from the heater core 6, and the difference between the radiator heat radiation amount 14 and the heater core heat radiation amount 12 is equal to or more than the predetermined value A, and/or when the temperature difference determining part 76 determines that the cooling effect on the engine cooling water by the radiator 8 is sufficiently larger than the cooling effect on the engine cooling water by the heater core 6, it is possible for the thermostat open failure detecting part 38 to determine that, among the state where the temperature of the engine cooling water is decreased due to the heat radiation of the heater core 6, and the state where the temperature of the engine cooling water is decreased due to the open failure of the thermostat 32, the latter (the state where the temperature of the engine cooling water is decreased due to the open failure of the thermostat 32) has happened, and thus, it is possible to detect the open failure of the thermostat 32 relatively easily with certainty.

In addition, according to the thermostat monitor 36 of the present embodiment, in a case where the relationship is established such that the radiator heat radiation amount 14 which is increased as the vehicle speed is increased, is larger than the heater core heat radiation amount 12 which is substantially constant even under a change in the vehicle speed, and that the difference between the radiator heat radiation amount 14 and the heater core heat radiation amount 12 is equal to or more than the predetermined value A, it is possible for the thermostat open failure detecting means 38 to determine that, among the state where the temperature of the engine cooling water is decreased due to the heat radiation of the heater core 6, and the state where the temperature of the engine cooling water is decreased due to the open failure of the thermostat 32, the latter (the state where the temperature of the engine cooling water is decreased due to the open failure of the thermostat 32) has happened, and thus, it is possible to detect the open failure of the thermostat 32 relatively easily with certainty.

In addition, according to the thermostat monitor 36 of the present embodiment, it is possible to detect the open failure of the thermostat 32 under the condition wherein the difference between the detected water temperature 44 of the engine cooling water and the external air temperature 46 is equal to or more than the predetermined value F (specifically, the condition where the cooling effect on the engine cooling water by the radiator 8 is sufficiently larger than the cooling effect on the engine cooling water by the heater core 6). Thus, in the present embodiment, it is possible to relatively easily distinguish the state where the temperature of the engine cooling water is decreased due to the open failure of the thermostat 32, and the state where the temperature of the engine cooling water is decreased due to the heat radiation of the heater core 6, and it is possible to detect the open failure of the thermostat 32 with certainty.

In addition, according to the thermostat monitor 36 of the present embodiment, when the temperature difference determining part 76 determines that the cooling effect on the engine cooling water by the radiator 8 is sufficiently larger than the cooling effect on the engine cooling water by the heater core 6, it is possible for the thermostat open failure detecting part 38 to detect that, among the state where the temperature of the engine cooling water is decreased due to the heat radiation of the heater core 6, and the state where the temperature of the engine cooling water is decreased due to the open failure of the thermostat 32, the latter (the state where the temperature of the engine cooling water is decreased due to the open failure of the thermostat 32) has happened. In the present embodiment, it is possible to detect the open failure of the thermostat 32 relatively easily with more certainty thereby.

LIST OF REFERENCE NUMERALS

1: engine cooling system
2: engine
4: engine cooling water channel system
6: heater core
8: radiator
12: heater core heat radiation amount
14: radiator heat radiation amount
16: in-engine cooling water channel
20: radiator-side cooling water channel
22: heater core-side cooling water channel
28: powertrain control module (PCM)
30: temperature sensor
32: thermostat
34: vehicle speed sensor
36: thermostat monitor
38: thermostat open failure detecting part
40: vehicle speed determining part
44: detected water temperature
46: external air temperature
76: temperature difference determining part

What is claimed is:

1. A thermostat monitor for detecting an open failure of a thermostat in an engine cooling water channel system, based on a temperature of an engine cooling water detected by a temperature sensor, the engine cooling water channel system having an engine, a heater core and a radiator of a vehicle positioned thereon, the engine cooling water channel system comprising an in-engine cooling water channel, a radiator-side cooling water channel and a heater core-side cooling water channel, the thermostat positioned on the radiator-side cooling water channel, and the temperature sensor positioned in the engine cooling water channel system between an outlet side of the engine and an inlet side of the heater core, wherein the thermostat monitor comprises a thermostat open failure detector that detects an occurrence of the open failure of the thermostat when:

a radiator heat radiation amount radiated from the radiator on the radiator-side cooling water channel is larger than a heater core heat radiation amount radiated from the heater core on the heater core-side cooling water channel, and a difference between the radiator heat radiation amount and the heater core heat radiation amount is equal to or more than a predetermined value, and the thermostat open failure detector refrains from detecting for the occurrence of the open failure of the thermostat when a vehicle speed of the vehicle is smaller than a predetermined speed.

2. The thermostat monitor as recited in claim 1, wherein the thermostat monitor further comprises a vehicle speed monitor which causes the thermostat open failure detector to start detecting for the occurrence of the open failure when vehicle speed of the vehicle is equal to or more than the predetermined speed, wherein the predetermined speed is set such that a relationship is established such that the radiator heat radiation amount is larger than the heater core heat radiation amount, and the difference between the radiator heat radiation amount and the heater core heat radiation amount is equal to or more than the predetermined value.

3. A thermostat monitor for detecting an open failure of a thermostat in an engine cooling water channel system, based on a temperature of an engine cooling water detected by a temperature sensor, the engine cooling water channel system having an engine, a heater core and a radiator of a vehicle positioned thereon, the engine cooling water channel system comprising an in-engine cooling water channel, a radiator-side cooling water channel and a heater core-side cooling water channel, the thermostat positioned on the radiator-side cooling water channel, and the temperature sensor positioned in the engine cooling water channel system between an outlet side of the engine and an inlet side of the heater core, wherein the thermostat monitor comprises a temperature difference detector which causes the detection for the open failure of the thermostat to start when a condition is met such that a temperature difference between the temperature of the engine cooling water detected by the temperature sensor and external air temperature is equal to or more than a predetermined value, and the thermostat monitor refrains from detecting for the occurrence of the open failure of the thermostat when a vehicle speed of the vehicle is smaller than a predetermined speed.

4. The thermostat monitor as recited in claim 3, wherein the thermostat monitor further comprises a thermostat open failure detector that detects an occurrence of the open failure of the thermostat when a condition is met such that a radiator heat radiation amount radiated from the radiator on the radiator-side cooling water channel is larger than a heater core heat radiation amount radiated from the heater core on the heater core-side cooling water channel, and that a difference between the radiator heat radiation amount and the heater core heat radiation amount is equal to or more than a predetermined value, wherein the thermostat open failure detector starts to detect for the occurrence when the condition for the temperature difference detector is met, and refrains from detecting for the occurrence of the open failure of the thermostat when the vehicle speed of the vehicle is smaller than the predetermined speed.

5. The thermostat monitor as recited in claim 4, wherein the thermostat monitor further comprises a vehicle speed monitor which causes the thermostat open failure detector to start detecting for the occurrence of the open failure when a condition is met such that the vehicle speed is equal to or more than the predetermined speed, wherein the predetermined speed is set such that a relationship is established such that the radiator heat radiation amount becomes larger than the heater core heat radiation amount, and that the difference between the radiator heat radiation amount and the heater core heat radiation amount becomes equal to or more than the predetermined value, wherein the thermostat open failure detector starts to detect for the occurrence when the condition for the temperature difference determining part is met, and the condition of the vehicle speed monitor is met.

6. A thermostat monitor for detecting an open failure of a thermostat in an engine cooling water channel system, based on a temperature of an engine cooling water detected by a temperature sensor, the engine cooling water channel system having an engine, a heater core and a radiator of a vehicle positioned thereon, the engine cooling water channel system comprising an in-engine cooling water channel, a radiator-side cooling water channel and a heater core-side cooling water channel, the thermostat positioned on the radiator-side cooling water channel, and the temperature sensor positioned in the vicinity of an outlet of the in-engine cooling water channel, wherein the thermostat monitor comprises a thermostat open failure detector that detects an occurrence of the open failure of the thermostat when:

a radiator heat radiation amount radiated from the radiator on the radiator-side cooling water channel is larger than a heater core heat radiation amount radiated from the heater core on the heater core-side cooling water channel, and a difference between the radiator heat radiation amount and the heater core heat radiation amount is equal to or more than a predetermined value, and the thermostat open failure detector refrains from detecting for the occurrence of the open failure of the thermostat when a vehicle speed of the vehicle is smaller than a predetermined speed.

* * * * *